US005361928A

United States Patent [19]

Stolzman

[11] Patent Number: 5,361,928

[45] Date of Patent: Nov. 8, 1994

[54] CLOSURE ASSEMBLY

[76] Inventor: Michael D. Stolzman, 28468 N. Ballard Dr., Lake Forest, Ill. 60045

[21] Appl. No.: 73,298

[22] Filed: Jun. 4, 1993

Related U.S. Application Data

[63] Continuation of Ser. No. 894,944, Jun. 8, 1992, abandoned.

[51] Int. Cl.[5] ..... B65D 53/00; B65D 45/32

[52] U.S. Cl. ..... 220/378; 220/320; 220/321

[58] Field of Search ..... 220/256, 319, 320, 321, 220/355, 356, 357, 358, 378, 308

[56] References Cited

U.S. PATENT DOCUMENTS

| | | | |
|---|---|---|---|
| 2,723,142 | 11/1955 | Stebbins | 220/358 X |
| 4,078,696 | 3/1978 | Crisci | 220/308 |
| 4,177,934 | 12/1979 | Hammes et al. | 220/319 |
| 4,344,546 | 8/1982 | Dry | 220/320 |
| 4,347,947 | 9/1982 | Hammes | 220/378 |
| 4,500,010 | 2/1985 | Schütz | 220/320 |
| 4,651,892 | 3/1987 | Boersma | 220/320 |
| 4,674,650 | 6/1987 | Hamilton et al. | 220/319 |
| 4,828,139 | 5/1989 | Capitani | 220/316 |
| 4,946,064 | 8/1990 | VanCucha | 220/355 |
| 5,065,885 | 11/1991 | Scaroni | 220/326 |
| 5,074,428 | 12/1991 | Wildfeuer | 220/322 |
| 5,129,537 | 7/1992 | Bordner et al. | 220/321 |

*Primary Examiner*—Allan N. Shoap
*Assistant Examiner*—Vanessa Caretto
*Attorney, Agent, or Firm*—Wood, Phillips, VanSanten, Hoffman & Ertel

[57] ABSTRACT

A closure assembly for sealingly closing the open top end of a material holding drum includes a cover and a rubber gasket. The cover has a central circular wall of a size corresponding to the drum open end and a peripheral flange which defines a downwardly opening annular channel for receiving the drum top end. The channel has a pair of radially spaced sidewalls, and each of the sidewalls has an annular rib for defining a seal receiving space within the channel. An annular rubber gasket is provided in the seal receiving space and has a contoured surface seated on a rounded chime on the top of the drum. The ribs engage opposite sides of the gasket to prevent lateral displacement of the gasket when the cover is fastened to the drum. An annular V-shaped groove on a top surface of the gasket defines a void between the gasket and the cover and in which a portion of the gasket is received when the gasket is deformed.

10 Claims, 1 Drawing Sheet

CLOSURE ASSEMBLY

This application is a continuation, of application Ser. No. 07/894,944, filed Jun. 8, 1992, now abandoned.

BACKGROUND OF THE INVENTION

1. Technical Field

The present invention relates generally to a closure assembly for a shipping and storage container, and more particularly toward an improved cover and gasket for sealing a material containing drum.

2. Background Art

Shipping and storage containers which have a cylindrical drum and removable lid are generally well known for reliably storing and/or transporting a variety of materials. In order to fill the drums, the lid is removed to define an opening in one end face of the drum and material is introduced into the drum. After filling is completed, the lid is replaced and appropriately secured to the drum.

In a typical storage drum, a cylindrical sidewall extends upwardly from a transverse base and terminates at an annular chime or bead at the top end of the drum. The chime has a rounded contour. In order to produce a seal between the lid and the drum when the lid is secured to the drum, liquid rubber or other resilient material is poured into a groove in the underside of the lid when the lid is inverted. The liquid is cured to form a solid compliant gasket which is adhered to the underside of the lid and the lid is fastened to the top of the drum.

The problem with using a poured gasket is that due to surface tension and related cohesion forces, the liquid develops a convex outer surface or meniscus which results in a corresponding rounded mating surface on the cured gasket. When the lid is fastened to the drum, the rounded chime engages the oppositely curved surface on the gasket. As a result, only a line contact is achieved between the gasket and the drum around the periphery of the open end. It is also possible for the gasket to "roll off" the top end face of the drum and further compromise the integrity of the seal.

In addition, non-uniformities in the liquid material and the resulting gasket cause localized zones of irregular hardness. When fastening force is applied to the lid, the variations in hardness cause "high spots" and "low spots" in the gasket and limit the effectiveness of the seal. Because the cured gasket is bonded to the lid, when unacceptable variations in the density of the cured liquid occur, the entire lid must be discarded.

The present invention is directed toward overcoming the persistent problems discussed above.

SUMMARY OF THE INVENTION

It is an object of the present invention, therefore, to provide a new and improved closure assembly for sealingly closing the open top end of a material containing drum.

In the exemplary embodiment, a closure assembly has a cover with a central circular wall of a size corresponding to a drum open end and a peripheral flange which defines a downwardly opening annular channel for receiving the drum top end.

In order to fasten the cover to the drum, a locking belt extends above an outer peripheral portion of the cover, and a locking mechanism is secured to opposite ends of the belt for drawing the ends together to clamp the cover and drum together.

An annular rubber gasket in the channel is positioned between the drum top end and the cover and has a top surface which is engaged with the peripheral flange of the cover. The drum top end has a rounded annular chime and the gasket has a complementarily contoured bottom surface seated on the chime. A V-shaped annular groove is provided in the top surface of the gasket so that when the gasket is deformed during fastening of the cover to the drum, a portion of the gasket is deformably expanded into the void defined by the groove between the peripheral flange and the top surface of the gasket.

The channel has a pair of radially spaced annular sidewalls which are integrated smoothly with an upper wall. An annular alignment rib is provided on each of the sidewalls. The alignment ribs extend radially into the channel and engage the gasket to constrain lateral displacement of the gasket and retain the gasket on the end surface of the drum when the cover is fastened thereto.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

DESCRIPTION OF THE PREFERRED EMBODIMENT

Figure 1:
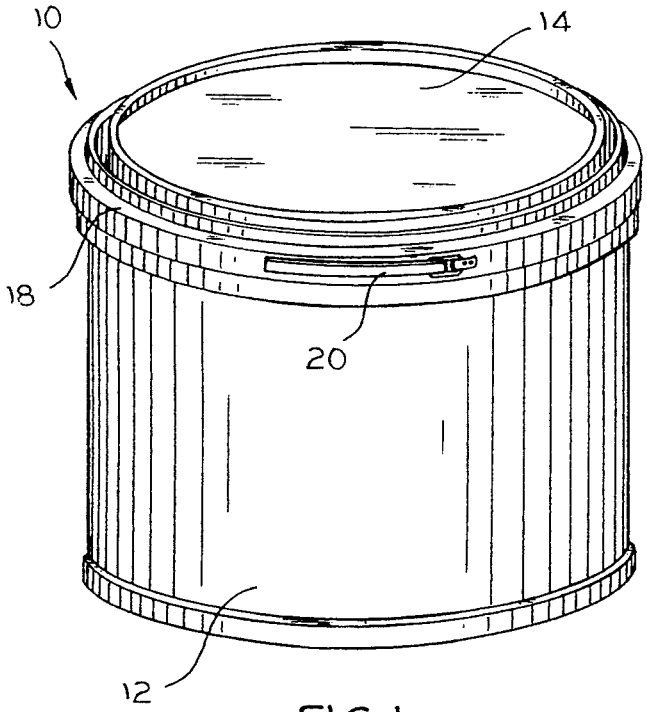
FIG. 1 is a perspective view of a shipping and storage container having a cover and rubber gasket according to the present invention.
Figure 2:
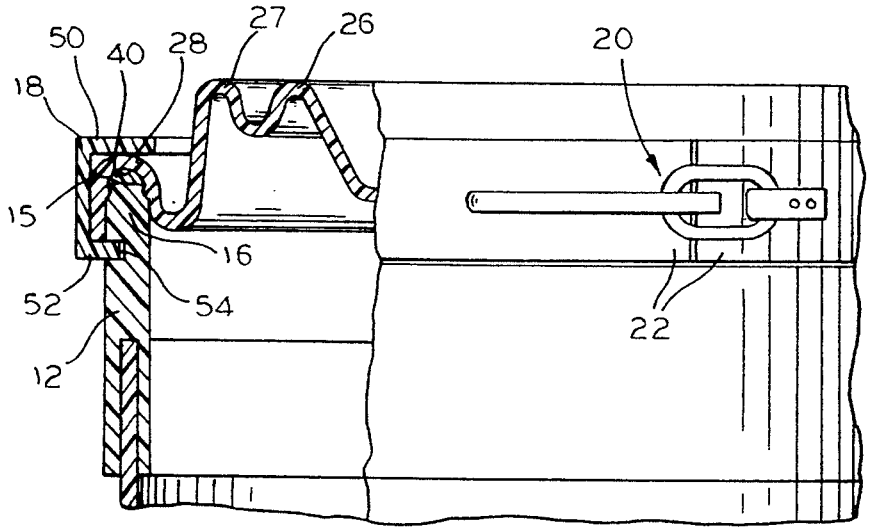
FIG. 2 is a diagrammatic illustration in partial section showing the cover fastened to a drum and the rubber gasket in a deformed condition.

FIGS. 1 and 2 illustrate a conventional shipping and storage container, generally designated 10, having a cylindrical fiberboard drum 12 and a cover 14. The cover 14 is secured to a rounded annular chime or bead 15 at the upper end 16 of the drum 12 and can be removed for filling the drum. A C-shaped locking belt 18 extends above an outer peripheral portion of the cover 14 and has a locking mechanism 20 secured to opposite ends 22 of the belt 18 for drawing the ends together to fasten the cover 14 to the drum 12.

Figure 5:
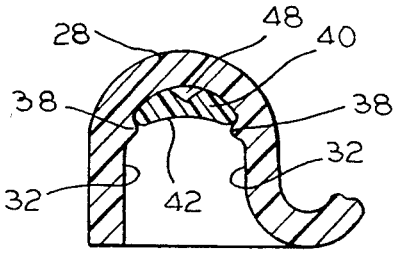
FIG. 5 is an enlarged fragmentary section showing the rubber gasket engaged by alignment ribs on the cover.
Figure 3:
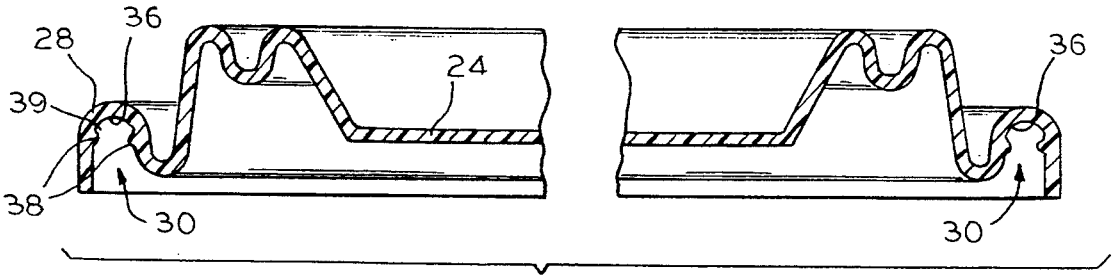
FIG. 3 is a fragmentary sectional view of the cover illustrated in FIG. 1.

Referring also to FIGS. 3 and 5, the cover 14 is of plastic, or alternatively metal, and has a central circular wall 24 of a size corresponding to the drum top end 16. A series of concentric rings 26–28 are molded or are stamped integrally with the cover 14 and define a generally corrugated structure around the periphery of the central wall 24. The inner rings 26 and 27 provide stiffening. The outermost ring 28 defines a peripheral flange having a downwardly opening annular channel 30 for receiving the chime 15.

More particularly, the ring 28 has a pair of integral annular sidewalls 32 connected with an arcuate upper wall 36 to define the channel 30. The sidewalls 32 are radially spaced apart a distance sufficient for closely embracing the chime 15 when the cover 14 is fastened thereto. The arcuate upper wall 36 is integrated smoothly between the sidewalls 32 and limits the depth to which the drum top end 16 is received in the channel 30. Each sidewall 32 has an integral annular rib 38 which projects substantially radially into the channel 30. The ribs 38 are axially aligned with each other and define an annular seal receiving space 39 in the channel 30.

A contoured annular gasket 40 in the channel 30 is seated on the rounded chime 15.

Figure 4:
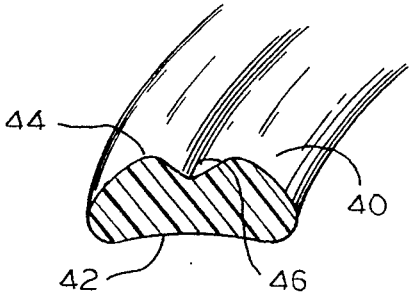
FIG. 4 is an enlarged diagrammatic illustration of the rubber gasket in an undeformed condition.

More specifically, and referring also to FIG. 4, the gasket 40 has a contoured bottom surface 42 which conforms to the curvature of the rounded chime 15 and an arcuate top surface 44 which engages the upper wall 36 of the channel 30. For purposes to be described hereafter, a generally V-shaped annular groove 46 is provided in the top surface 44 of gasket 40 so as to define a void 48 between the gasket 40 and the upper wall 36 when the gasket 40 is in an undeformed condition (see FIG. 5). The gasket 40 preferably is made of rubber, such as the product marketed under the tradename Santoprene by Monsanto Corporation, St. Louis, Mo.

Prior to fastening the cover 14 to the drum 12, the gasket 40 is snap fit into the annular space 39 on the underside of the cover 14. The gasket 40 has a uniform thickness which is selected such that when the contoured surface 42 of the gasket 40 is supported on the aligned annular ribs 38, the arcuate top surface 44 is engaged with the upper wall 36 of the channel 30. The installed gasket 40 thus is circumferentially movable within the channel 30, while the opposed ribs 38 constrain radial displacement of the gasket 40. In applications where it is desired to prevent all relative movement between the installed gasket 40 and the cover 14, a light adhesive is sprayed into the channel 30.

Once the gasket 40 is mounted in the channel 30, the cover 14 is lowered onto the drum 12 and the drum top end 16 is snugly received between the sidewalls 32 of the channel 30. Because lateral displacement of the gasket 40 is constrained by the ribs 38, the gasket 40 is accurately positioned on the chime 15. The C-shaped locking belt 18 is then placed around the cover 14 with an upper radial flange 50 overlying the radial outermost stiffening ring 28 and a lower radial flange 52 aligned with a peripheral notch 54 in the drum 12. When the mechanism 20 on the locking belt 18 is actuated to draw the belt ends 22 together, the lower flange 52 is received in the notch 54 and the cover 14 is drawn axially toward the chime 15. The gasket 40 is captured between the cover 14 and the drum 12 and is compressed into sealing engagement with the chime 15 when the mechanism 20 is actuated.

As the gasket 40 is compressed, a volume of the rubber is deformably expanded into the void 48 defined by the V-shaped groove 46 (see FIG. 2). The gasket 40 thus has freedom to expand without inducing excessive compressive forces in the cover 14. In addition, the hardness of the gasket 40 remains substantially uniform and "high" or "low" spots do not develop. The complementary contours of the bottom surface 42 of the gasket 40 and the chime 15 of the drum 12 reduce the risk of "roll off" and insure a reliable seal across the entire width of the chime 15.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a container for holding materials, said container including a tubular drum open at a top end, a closure assembly for sealingly closing said drum at the top end comprising:

a cover having a central circular wall of a size corresponding to the drum open end and a peripheral flange defining an annular channel on the cover, said channel having an upper wall and a pair of downwardly extending opposed sidewalls integral therewith, said sidewalls defining a downward opening in the channel;

means for fastening the cover to the drum;

a rib on each of the sidewalls intermediate said upper wall and said channel opening, said ribs extending inwardly of said side walls toward each other, there being a reduced opening in the channel between inner most points of said ribs; and a gasket supported on the ribs entirely above said reduced opening whereby the drum top end is receivable in said channel opening and said reduced opening for capturing said gasket between the ribs and the upper wall and said gasket is compressed into sealing engagement with said drum top end when said cover is fastened thereto.

2. The closure assembly of claim 1 in which the gasket has a bottom surface which is concave downward and terminates at opposite ends supported on said ribs whereby said ribs hold the gasket in alignment with said reduced opening before the drum open end is received therein.

3. The closure assembly of claim 1 in which the gasket is made of rubber.

4. The closure assembly of claim 1 in which the gasket is annular.

5. The closure assembly of claim 1 in which the gasket has an annular groove.

6. The closure assembly of claim 5 in which the groove is substantially V-shaped.

7. The closure assembly of claim 1 in which the means for fastening the cover to the drum comprises a locking belt extending above an outer peripheral portion of the cover and a locking mechanism secured to opposite ends of the belt for drawing the ends together to clamp the cover and drum together.

8. The closure assembly of claim 1 in which the gasket is deformable and has a top surface which is engaged with the peripheral flange, the top surface having a groove for defining a void between the gasket and the cover when the gasket is in an undeformed state and in which a portion of the gasket is received when the gasket is deformed.

9. In a container for holding materials, said container including a tubular drum open at a top end, said top end having a rounded edge with a convex upward surface, a closure assembly for sealingly closing said drum at the top end comprising:

a cover having a central circular wall of a size corresponding to the drum open end and a peripheral flange defining a downwardly opening channel on the cover for receiving said drum open end;

means for fastening the cover to the drum; and a resilient gasket in the channel between the drum and the cover, said gasket having an undeformed state when the cover is not fastened to the drum and a deformed state when the cover is fastened to the drum, the gasket in said undeformed state having a bottom surface which is concave downward and is complementary to the convex upward surface on the drum top end, said channel having an arcuate upper wall and a pair of downwardly extending opposed sidewalls integral therewith, and a rib on each of the sidewalls extending inwardly of said side walls toward each other, said gasket bottom surface having opposite ends supported on said ribs whereby said ribs hold the bottom surface in alignment with said channel opening before the drum open end is received therein, and wherein there is a reduced opening in the channel between inner most points of said ribs, said gasket being supported on the ribs entirely above said reduced opening whereby the drum top end is receivable in said channel opening and said reduced opening for engaging said convex drum surface with said concave gasket surface and holding said gasket in sealing engagement with said channel upper wall.

10. The closure assembly of claim 9 in which the gasket has a convex top surface engaged with the channel upper wall, the top surface having a groove for defining a void between the gasket and the cover when the gasket is in the undeformed state and in which a portion of the gasket is received when the drum top end is received in said reduced opening and compresses the gasket into sealing engagement with said drum top end.

* * * * *